US007201000B2

(12) United States Patent
Kurkaev et al.

(10) Patent No.: US 7,201,000 B2
(45) Date of Patent: Apr. 10, 2007

(54) METHOD FOR HEATING OR COOLING FLUID MEDIUM

(75) Inventors: Abdul Sultanovich Kurkaev, ul. Furmana, d. 161,kv.20, 480091 Alma-Aty (KZ); Isa Sultanovich Kurkaev, Alma-Aty (KZ); Georgy Konstantinovich Manastyrly, St. Petersburg (RU); Elena Antonovna Alieva, St. Petersburg (RU); Natalya Vasilievna Logvina, St. Petersburg (RU)

(73) Assignee: Abdul Sultanovich Kurkaev, Alma-Aty (KZ)

( * ) Notice: Subject to any disclaimer, the term of this patent is extended or adjusted under 35 U.S.C. 154(b) by 0 days.

(21) Appl. No.: 10/559,402

(22) PCT Filed: Jun. 3, 2004

(86) PCT No.: PCT/RU2004/000222

§ 371 (c)(1),
(2), (4) Date: Dec. 5, 2005

(87) PCT Pub. No.: WO2004/105909

PCT Pub. Date: Dec. 9, 2004

(65) Prior Publication Data

US 2006/0113067 A1 Jun. 1, 2006

(30) Foreign Application Priority Data

Jun. 3, 2003 (RU) ..... 2003116180

(51) Int. Cl.
*F25B 21/02* (2006.01)

(52) U.S. Cl. ..... 62/3.3; 62/238.2

(58) Field of Classification Search ..... 62/3.2, 62/3.3, 238.2, 238.7, 406; 165/104.34
See application file for complete search history.

(56) References Cited

U.S. PATENT DOCUMENTS 5,540,826 A * 7/1996 Bier et al. ..... 204/610
5,901,572 A * 5/1999 Peiffer et al. ..... 62/480

FOREIGN PATENT DOCUMENTS

| | | |
|---|---|---|
| RU | 2047069 | 10/1995 |
| RU | 2095125 | 11/1997 |
| RU | 2140365 | 10/1999 |
| SU | 688351 | 9/1979 |

* cited by examiner

*Primary Examiner*—Melvin Jones
(74) *Attorney, Agent, or Firm*—Henry M. Feiereisen

(57) ABSTRACT

The invention relates to heating engineering. The inventive method for heating or cooling fluid medium consists in supplying a cooled or heated fluid medium in a through channel and in subsequently heating or cooling said fluid medium therein at least in two stages. Said through channel is divided into heating and cooling stages having the same length. The temperature of each stage increases in the case of heating and reduces in the case of cooling stepwisely and directly proportionally in a direction away from the thirst stage to the next stage. The heated or cooled water is supplied to the through channel tangentially at an angle of 45–90° to the generatrix of the internal surface thereof at a point where the fluid medium is introduced. Said invention increases the efficiency of the process of heating or cooling said fluid medium.

5 Claims, 1 Drawing Sheet

METHOD FOR HEATING OR COOLING FLUID MEDIUM

TECHNICAL FIELD

This invention relates to the sphere of heating engineering especially to various systems operated with heated or cooled fluid or gaseous mediums, e.g. heating systems, ventilation or conditioning units in industrial and domestic compartments.

BACKGROUND ART

There is an air cooling method performed by an air-conditioning system in transport cabs and cabins (see Certificate of authorship USSR, No. 688351, Sep. 30, 1979). The air-conditioning system consists of a thermoelectric generator connected to a DC network, a filter-ventilation system, a liquid thermal conduction module, integrated with radiation—convection panels. Radiation surfaces of these panels are directed to the pilot place, at that the adverse side of the panels has a thermal contact with thermoelectric batteries. Panels are equipped with inner air channels and connected to collectors with discharge cocks. This appliance can be operated in aeration, radiation, radiant, radiation-convection cooling or heating modes. During partially heat sinking from hot junctions of the thermal battery, it can also be attempered with air, cooled down lower than a dew-point. That allows increasing considerately the air conditioning efficiency and—in the event of heat air attack to the cabin—to assuring comfortable conditions due to complex influence on the air inside the cabin.

However, this method of the air heating and cooling has low power efficiency and is also remarkable for high power consumption for air conditioning; all these facts restrict wide application of air-conditioning systems as a universal cabin aeration unit.

Mostly near to the technical essence and achieved results of this invention stands a liquid medium heating or cooling method, which stipulates supply of the heated or cooled liquid medium into a flowing channel and its further heating or cooling on at least two stages (see Patent RF 2140365, cl. F 25 B 29/00, Oct. 27, 1999).

This liquid medium heating or cooling method allows considerately increasing the heating or resp. cooling efficiency of the liquid medium due to a stage-by-stage treatment of the medium. However, this method does not ensure a high efficiency in energy conversion during heating or cooling that occurs because of unavailability of an optimal algorithm of the liquid medium heating or cooling processes.

DISCLOSURE OF INVENTION

This invention is developed to get the maximum efficiency of the liquid medium heating and cooling processes at minimum power consumption provided by application of two or more staged cold and heat generators.

This liquid medium heating or cooling method includes such procedures as supply of the cooled or heated liquid medium into a flowing channel and its further heating or cooling on at least two stages. At that the flowing channel is divided into two stages of cooling and heating, both of the equal length, whereas a temperature of each stage—towards from the first to the next one in spurts and in direct proportion—is getting higher by heating or respectively is getting lower by cooling. At that, a cooled or a heated liquid medium is pumped into a flowing channel tangentially angle-wise towards generating ray of the flowing channel on the liquid medium inlet at a temperature of 45° C. to 90° C.

By analyzing different types of the liquid medium cooling or heating appliance, one can mention, that the way of interaction between the heated and the cooled mediums exerts a big influence on the heat transmission efficiency. The heat exchanging rationally arranged improving overall dimensions of the liquid medium heating or cooling appliances as well as reducing considerably the energy necessary for the heating or cooling. Liquid medium heating or cooling stages performed with an equal length at relatively spurted temperature changes of the heating or cooling stage allows maintaining along the channel a relatively equal temperature difference between a heating or cooling source and a liquid medium. Within turbulization of the liquid medium flow—by spinning at the flowing channel inlet—it also let equalize the temperature of the liquid medium in cross-section by generous and consistent heating or cooling.

Figure 1:
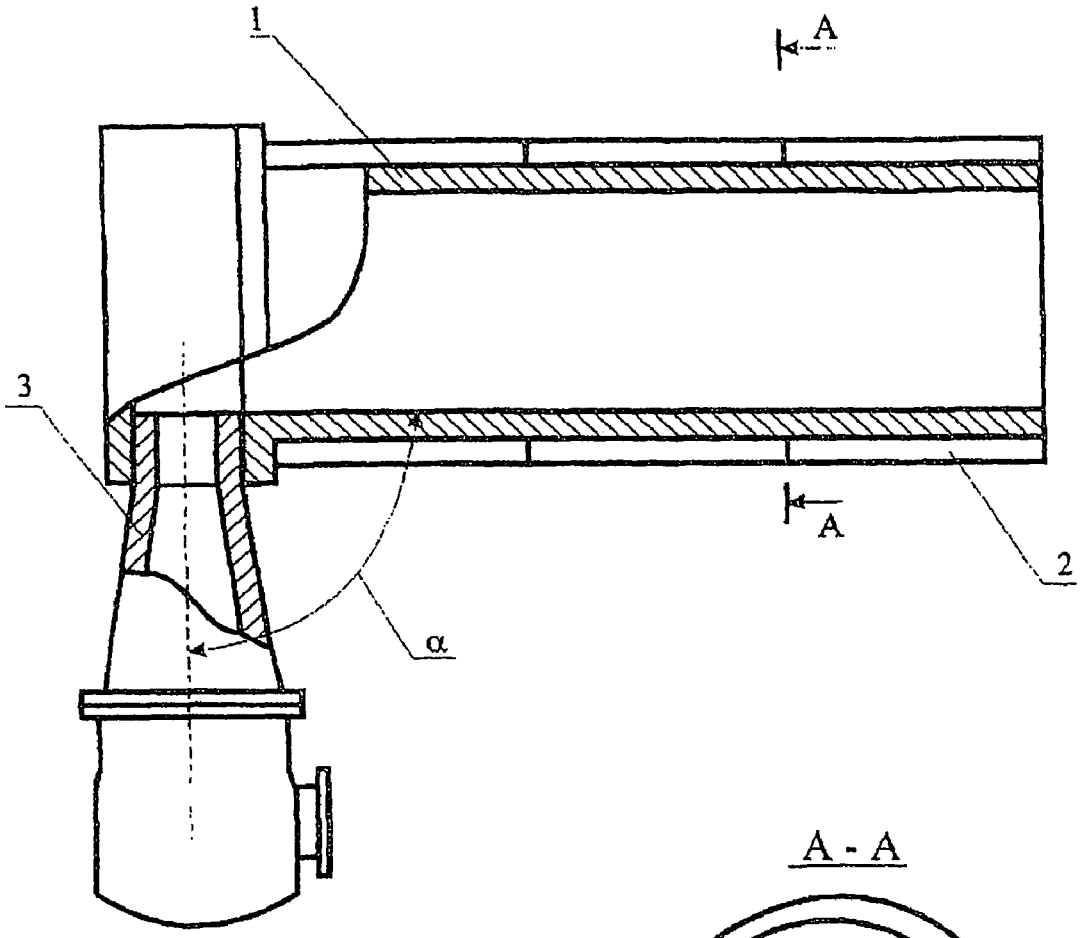
FIG. 1 shows a schematic cross-section of an apparatus for heating or cooling a fluid.
Figure 2:
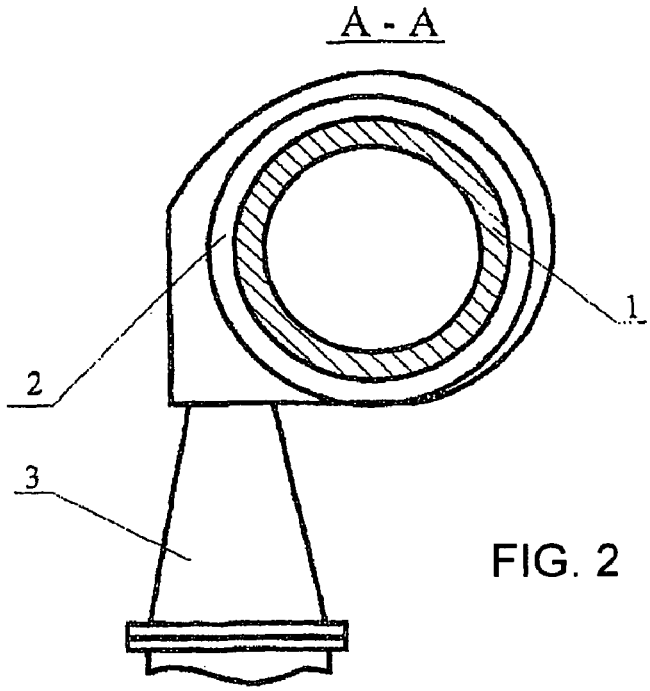
FIG. 2 shows a partly sectional view of the apparatus, taken along the line A—A of FIG. 1.

An apparatus for heating or cooling a fluid includes a housing which defines a flow channel 1, and a plurality of stages 2 of equal length for cooling down or warming up the fluid (gas or liquid) which flows inside the flow channel 1 of the housing. The stages 2 can each be made as a jacket around of the flow channel 1, which jacket 2 together with an outer wall of the flow channel 1 creates a cavity, to which an agent (heating agent or refrigerant) is pumped or they can be performed, for instance, as thermoelectric batteries mounted on the outer surface of the flow channel 1. At that these thermoelectric batteries are connected to the power network so that they create stages of the equal length, to which a power is supplied, increasing from one stage to another in direct proportion and in spurts. Respectively, heat carrier (heating agent or refrigerant, e.g. alcohol, Freon or liquid ammonia) is pumped into the jackets; temperature of this heat carrier is increasing or decreasing stage by stage and in direct proportion. As an example, a heat carrier can be pumped into the jackets or (in the case with thermoelectric batteries) first stage can be tempered to 14° C., the second one to 28° C. and the third to 42° C. The heat carrier with the temperature required can be obtained and supplied by a vapor compression machine. Such a machine can be applied to heat a fluid as well as to cool it down. At that, the jackets—in one case—creating cavities around the flow channel 1, act as a condenser, in other case they serve for an evaporator of the vapor compressor machine. The fluid enters the flow channel 1 tangentially through a jet or a nipple 3 (the last is better). At that the jet or the nipple 3 are mounted at an angle $\alpha$ in relation to the flow channel 1, generating ray of the flow channel 1 on the liquid medium inlet at a temperature of 45° C. to 90° C.

BEST MODE FOR CARRYING OUT THE INVENTION

This method of the liquid medium heating or cooling is described below.

The liquid medium (heat or cold) enters the flow channel 1 through a jet or a nipple 3. In the flow channel 1 a successive heating or cooling of the liquid medium takes place on two stages 2 at least. Temperature of each stage 2 (from the first one to the next) is rising in spurts and in direct proportion in* the case of heating or is falling down in the case of cooling. As a result, a successive heating or cooling of the liquid medium takes place in the flow channel 1.

By applying thermoelectric batteries, they are connected to the DC network via a control panel, which allow to change polarity of the voltage supplied, it also let change operating modes of the batteries: to heat or to cool down the liquid medium in the flow channel 1. It is possible, if necessary, to perform the heating or cooling stages divided forward the liquid medium for two heat insulated from each other stages of heating or cooling. In this case, a different working voltage is supplied, as described above, to the thermoelectric batteries. At that the voltage on the batteries of the second and all the next stages exceeds voltage on the batteries of the first stage in direct proportion.

INDUSTRIAL APPLICABILITY

The above mentioned liquid medium heating or cooling method ensures an effective cooling or heating of gas or liquid, it can be applied in oil-refining industry, e.g., by the heat treatment of the liquefied gases in oil and petrochemical industries, in order to cool down a slop or for instance a margarine emulsion, as well as in air-conditioning systems for air heating or cooling.

The invention claimed is:

1. A method of heating or cooling a fluid, comprising the steps of:

feeding a fluid tangentially into a flow channel; and subjecting the fluid in at least two stages of same length to different temperatures, as the fluid flows through the flow channel, such that the temperature increases abruptly from stage to stage in the event the fluid is to be heated, or decreases abruptly from stage to stage in the event the fluid is to be cooled.

2. The method of claim 1, wherein the fluid enters the flow channel at a temperature of 45° C. to 90° C.

3. Apparatus for heating or cooling a fluid, comprising:

a housing having an interior defining a flow channel for a fluid;

a feed member positioned to supply the fluid tangentially into the flow channel;

an outer jacket placed in concentric surrounding relationship to the housing, said outer jacket being subdivided into at least two sections of same length to define at least two successive stages to subject the fluid to two different temperatures as the fluid flows through the flow channel, wherein the temperature increases abruptly from section to section in the event the fluid is to be heated, or decreases abruptly from stage to stage in the event the fluid is to be cooled.

4. The apparatus of claim 3, wherein each of the sections is constructed for circulation of a heat transfer medium.

5. The apparatus of claim 3, wherein each of the sections is constructed in the form of a thermoelectric battery.

* * * * *